166-275 SR
7/1/86 XR 4,597,444

United States Patent [19]
Hutchinson

[11] Patent Number: 4,597,444
[45] Date of Patent: Jul. 1, 1986

[54] METHOD FOR EXCAVATING A LARGE DIAMETER SHAFT INTO THE EARTH AND AT LEAST PARTIALLY THROUGH AN OIL-BEARING FORMATION

[75] Inventor: Thomas S. Hutchinson, Dallas, Tex.

[73] Assignee: Atlantic Richfield Company, Los Angeles, Calif.

[21] Appl. No.: 653,103

[22] Filed: Sep. 21, 1984

[51] Int. Cl.[4] ..... E21B 36/00; E21B 43/24; E21B 43/30

[52] U.S. Cl. ..... 166/302; 166/272; 166/245; 166/275; 405/130

[58] Field of Search ..... 166/245, 272, 302, 303, 166/268, 263, 243, 270, 275; 299/10, 11, 16, 17; 405/130, 234, 56

[56] References Cited

U.S. PATENT DOCUMENTS

| | | | |
|---|---|---|---|
| 2,777,679 | 1/1957 | Ljungstrom | 166/245 |
| 2,862,558 | 12/1958 | Dixon | 166/272 |
| 2,897,894 | 8/1959 | Draper et al. | 166/272 |
| 3,183,675 | 5/1965 | Schroeder | 405/130 X |
| 3,267,680 | 8/1966 | Schlumberger | 405/130 |
| 3,271,962 | 9/1966 | Dahms et al. | 405/130 |
| 3,279,538 | 10/1966 | Dosher | 166/263 |
| 3,344,607 | 10/1967 | Vignovich | 405/56 |
| 3,354,654 | 11/1967 | Vignovich | 405/56 |
| 4,474,238 | 10/1984 | Gentry et al. | 166/245 X |

*Primary Examiner*—Stephen J. Novosad
*Assistant Examiner*—David J. Bagnell
*Attorney, Agent, or Firm*—F. Lindsey Scott

[57] ABSTRACT

A method for positioning a large diameter shaft from the surface into the earth and at least partially through a subterranean oil-bearing formation, said method comprising (a) Positioning a central well near the center of a selected shaft location, said central well extending at least partially through said oil-bearing formation;
(b) Positioning a plurality of wells at a selected distance outside the diameter of said shaft and about said shaft, said wells extending at least partially through said oil-bearing formation;
(c) Injecting a fluid through at least a portion of said wells into said oil-bearing formation to remove oil from said oil-bearing formation;
(d) Producing fluids from said central well;
(e) Injecting water into said oil-bearing formation through said portion of said wells after the injection of said fluid through said portion of the said wells;
(f) Freezing a zone about said location; and,
(g) Excavating said shaft.

11 Claims, 6 Drawing Figures

METHOD FOR EXCAVATING A LARGE DIAMETER SHAFT INTO THE EARTH AND AT LEAST PARTIALLY THROUGH AN OIL-BEARING FORMATION

This invention relates to methods for positioning large diameter shafts into the earth.

This invention further relates to methods for positioning large diameter shafts into the earth using freezing techniques.

In the excavation of large diameter shafts into the earth for the recovery of minerals or other materials from the earth, problems are frequently encountered as the result of the nature of the subterranean formations through which the shaft is excavated. When weakly consolidated or unconsolidated formations are encountered, problems can result from the collapse of the sides of the shaft, from the flow of unconsolidated material into the shaft and the like. One method for overcoming such problems has been the positioning of wells about the outer diameter of the large diameter shaft and freezing the formation surrounding the shaft prior to excavating the shaft by circulating a heat transfer fluid in the wells surrounding the large diameter shaft. Such freezing techniques have been effective in many water-bearing formations. However, when oil-bearing formations are encountered there may be little or no water in the oil-bearing formation to freeze. While the viscosity of the oil contained in the oil-bearing formation can be increased by reducing the temperature in such formations, the resulting formation strength after chilling is considerably less than that obtained by freezing water-bearing formations.

In recent years there has been considerable interest in obtaining hydrocarbonaceous materials from subterranean formations which have not been previously produced as a result of the nature of the hydrocarbonaceous material, the location of the formation and the like. One approach proposed recently and described in U.S. Ser. No. 524,261 entitled "A Method For Recovering Mineral Values From A Subterranean Formation Through Wellbores Penetrating the Formation From Tunnels" filed Aug. 18, 1983 by Thomas S. Hutchinson and Robert M. Miller, Jr. involves the use of large diameter shafts and tunnels for the production of oils from a subterranean oil-bearing formation. In the positioning of such shafts which may extend at least partially through subterranean oil-bearing formations, it is desirable that some method be available for increasing the strength of the formation surrounding the large diameter shaft during excavation of the shaft.

According to the present invention, a large diameter shaft is readily positioned from the surface into the earth and at least partially through a subterrean oil-bearing formation by a method comprising (a) Positioning a central well near the center of a selected shaft location, the central well extending at least partially through the oil-bearing formation;

(b) Positioning a plurality of wells at a selected distance outside the diameter of the shaft and about the shaft, the wells extending at least partially through the oil-bearing formation;

(c) Injecting a fluid through at least a portion of the wells into the oil-bearing formation to remove oil from the oil-bearing formation;

(d) Producing fluids from the central well;

(e) Injecting water into the oil-bearing formation through the wells after the injection of the fluid through the portion of the wells;

(f) Freezing a zone about the location; and, (g) Excavating the shaft.

In the discussion of the Figures, the same numbers will be used throughout to refer to the same or similar components.

Figure 1:
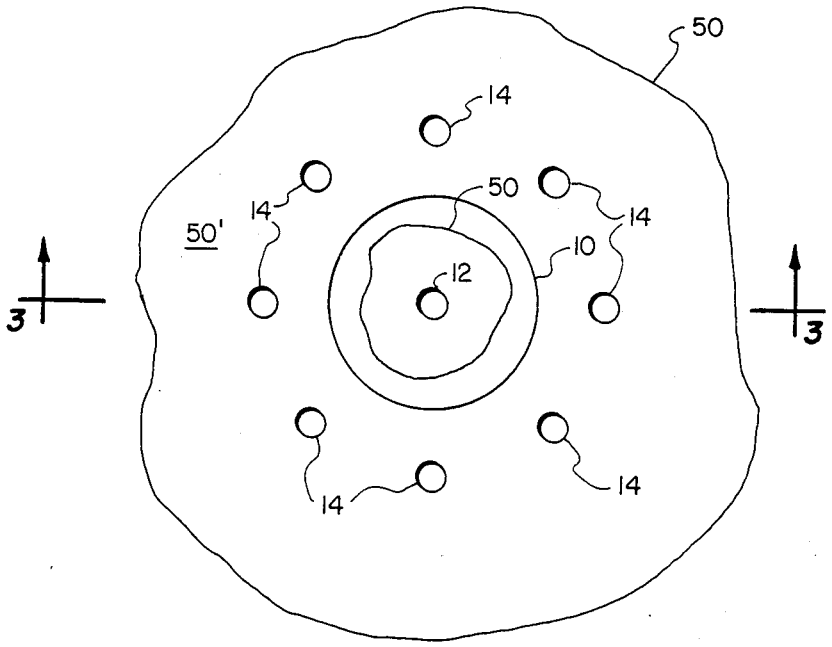
FIG. 1 is a topographic view of a well layout adapted to freezing a subterranean formation about a zone selected for the excavation of a large diameter shaft.

In FIG. 1, a selected large diameter shaft evacuation zone is shown as a shaft diameter 10. Shaft diameter 10 represents the location chosen for the subsequent evacuation of a large diameter shaft into the earth. A central well 12 is drilled and cased generally near the center of shaft diameter 10 and a plurality of wells 14 are drilled outside shaft diameter 10 in a generally circular pattern about shaft diameter 10. Wells 14 may be located at a distance from about 5 to about 20 feet outside shaft diameter 10. More commonly wells 14 are from about 10 to about 15 feet outside shaft diameter 10. Wells 14 are located at a spacing suitable for the formation of a frozen zone 50' outlined by lines 50. Frozen zone 50' will extend downwardly into the earth about wells 14 and typically to some depth beyond the bottom of wells 14 as a result of the circulation of a heat transfer fluid in wells 14. Frequently frozen zone 50' surrounds but does not completely fill diameter 10 where the large diameter shaft is to be evacuated. It is desirable that the wall areas of the large diameter shaft be frozen during excavation but it is not necessary that the central portion of the large diameter shaft, which typically may have a diameter up to and in some instances even larger than 20 feet, be frozen. Clearly, the structural support desired in the wall areas can be achieved without freezing the entire center of the area to be evacuated to form the large diameter shaft.

Figure 2:
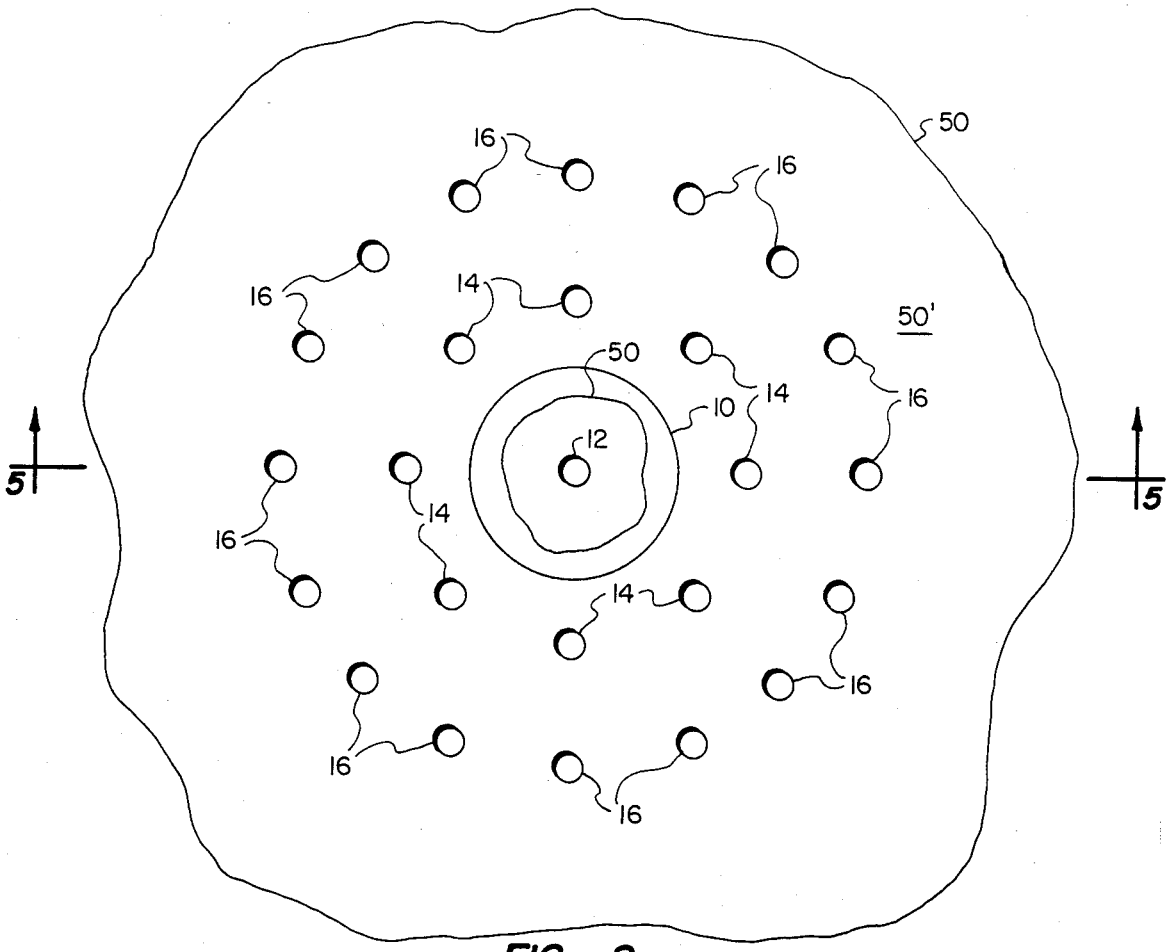
FIG. 2 is a topographic view of an alternate well layout adapted to freezing a subterranean formation about a zone selected for the excavation of a large diameter shaft.

In FIG. 2, a similar arrangement is shown. In addition to wells 14, an outer plurality of wells 16 is used to form a larger freeze zone and for other purposes as will be more fully discussed hereinafter.

Figure 3:
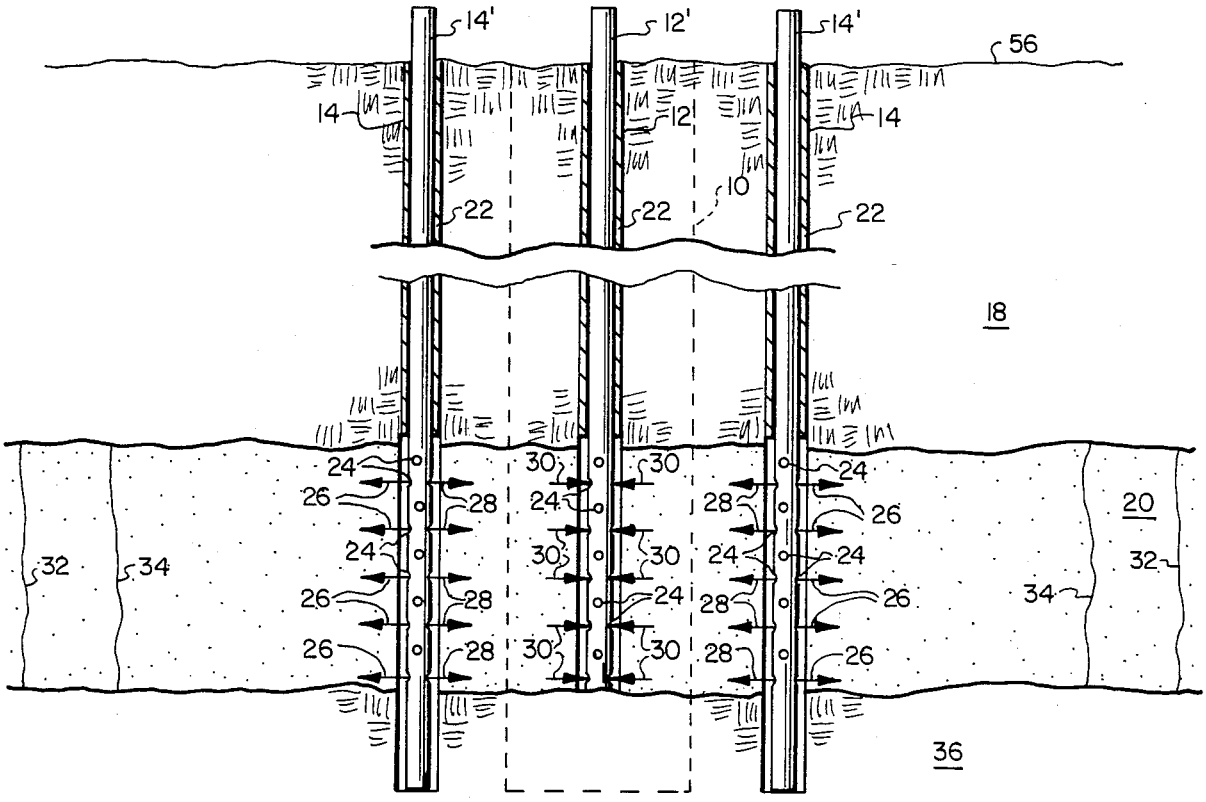
FIG. 3 is a schematic view of the well layout in FIG. 1 taken at line 3.3.

In FIG. 3, a subterranean oil-bearing formation 20 is shown positioned beneath an overburden 18 which may comprise a plurality of subterranean formations (not shown) between oil-bearing formation 20 and the surface 56. An underlying formation 36 is also shown. Central well 12 is shown as a drilled, cased well which extends to near the bottom of oil-bearing formation 20. A casing 12' is cemented in place by cement 22. A plurality of perforations 24 in the portion of casing 12' positioned in oil-bearing formation 20 permits fluid communication between the annulus of casing 12' and oil-bearing formation 20. Wells 14 are shown as cased wells extending through oil-bearing formation 20. A casing 14' is cemented in place by cement 22 in each of wells 14 and includes a plurality of perforations 24 to permit fluid communication between the annulus of casings 14' and oil-bearing formation 20. In the practice of the present invention, a suitable fluid is injected through wells 14 and into oil-bearing formation 20 to remove oil from formation 20. The flow of fluids from wells 14 is as shown by arrows 26 outwardly from diameter 10 to push oil away from the area where the large diameter shaft is to be excavated. The large diameter shaft excavation area is shown in FIG. 3 by dotted line 10 and generally corresponds to diameter 10 in FIG. 1. Fluid also flows inwardly from wells 14 toward central well 12 as shown by arrows 28. Fluids comprising oil and in some instances the injected fluid and water, flow into well 12 as shown by arrows 30 and are recovered from central well 12. The net result is the removal of oil from oil-bearing formation 20 between wells 14 and central well 12 and the removal of oil from oil-bearing formation 20 outside wells 14 by moving the oil outwardly from diameter 10 as shown by arrows 26. After a major portion of the oil has been removed from oil-bearing formation 20 in this fashion, water is injected in a similar manner and serves to push the injected fluid and oil outwardly from wells 14 and inwardly toward central well 12 from which such fluids may be produced. As the result of this sequence of operations, oil contained in oil-bearing formation 20 outside wells 14 is pushed outward to a zone beyond a line shown in FIG. 3 as line 32 with the injected fluids having been pushed outwardly from wells 14 by the water injection to a zone beyond a line shown generally in FIG. 3 as line 34. The injected water then occupies the area between central well 12 and wells 14 and out to line 34. Formation 20 may then be frozen to produce a frozen zone having suitable strength. After formation 20 has been so treated, wells 14 may be converted to wells suitable for the circulation of heat transfer fluids to freeze a zone around diameter 10. Such a conversion can be made by closing perforations 24 in wells 14 by a conventional cement squeeze treatment wherein packers are placed below and above the perforated zone with cement then being forced under pressure into the perforations to close the perforations. The perforations in central well 12 may also be closed in a similar fashion if desired. Such well treatments are considered to be known to those skilled in the art.

Figure 4:
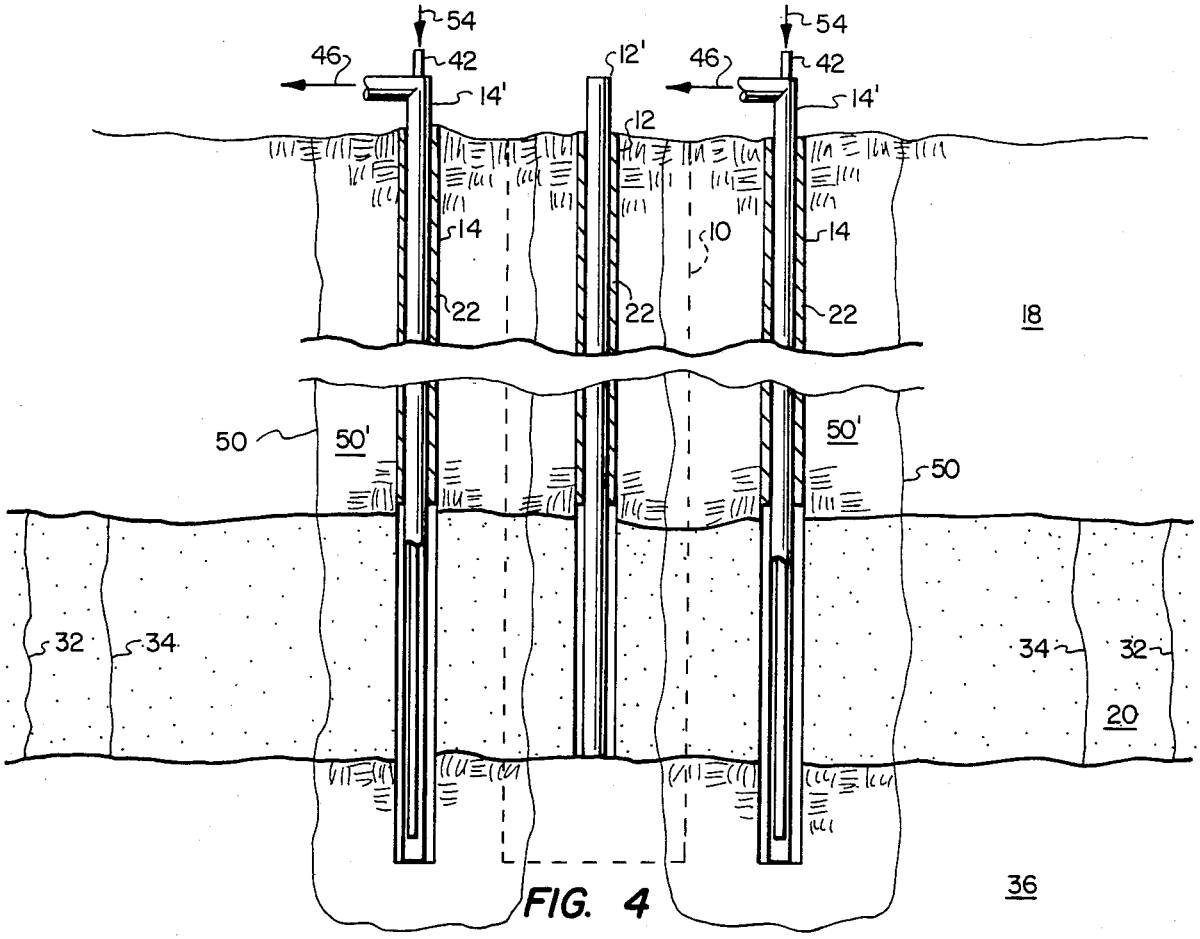
FIG. 4 is a schematic view of the well layout shown FIG. 3 after formation of a frozen zone surrounding a large shaft evacuation zone; and, FIG. 5 is a schematic view of the well layout shown in FIG. 2 taken at line 5.5.

In FIG. 4, a similar well arrangement where the perforations have been closed and a tubing 42 positioned in casing 14' is shown. After positioning tubing 42 in wells 14, a heat transfer solution is injected downwardly into wells 14 through tubing 42 as shown by arrows 54 and circulated back upwardly through the annulus between tubing 42 and casing 14' for recovery as shown by arrows 46. The heat transfer fluid is then passed to cooling and optionally recycled back through tubing 42. Heat exchange fluids are selected which can be chilled to a temperature sufficiently low to freeze the water in the formations surrounding wells 14. After a suitable period of circulation, a freeze zone 50' shown by lines 50 is formed which generally surrounds diameter 10. At this point, the large diameter shaft can be excavated in the area shown by dotted line 10. The width of the freeze zone, the spacing of wells 14 and the like are readily determined by means known to those skilled in the art based upon the strength required in freeze zone 50', the depth to which the large diameter shaft is to be excavated and the like. By the method of the present invention, a strong frozen zone is provided even through an oil-bearing formation. Such is not accomplished by simply freezing such oil-bearing formations since the oil contained in such formations frequently does not freeze at temperatures as high as the freezing point of water. Even though the viscosity of the oil contained in such formations may be increased by chilling, it is usually not frozen at temperatures as high as the freezing point of water. Similarly, brines which may be present in oil-bearing formations in some instances are also removed by the use of the method of the present invention so that strong freeze zones may be formed in zones which may have been at least partially brine saturated in their natural state.

Figure 5:
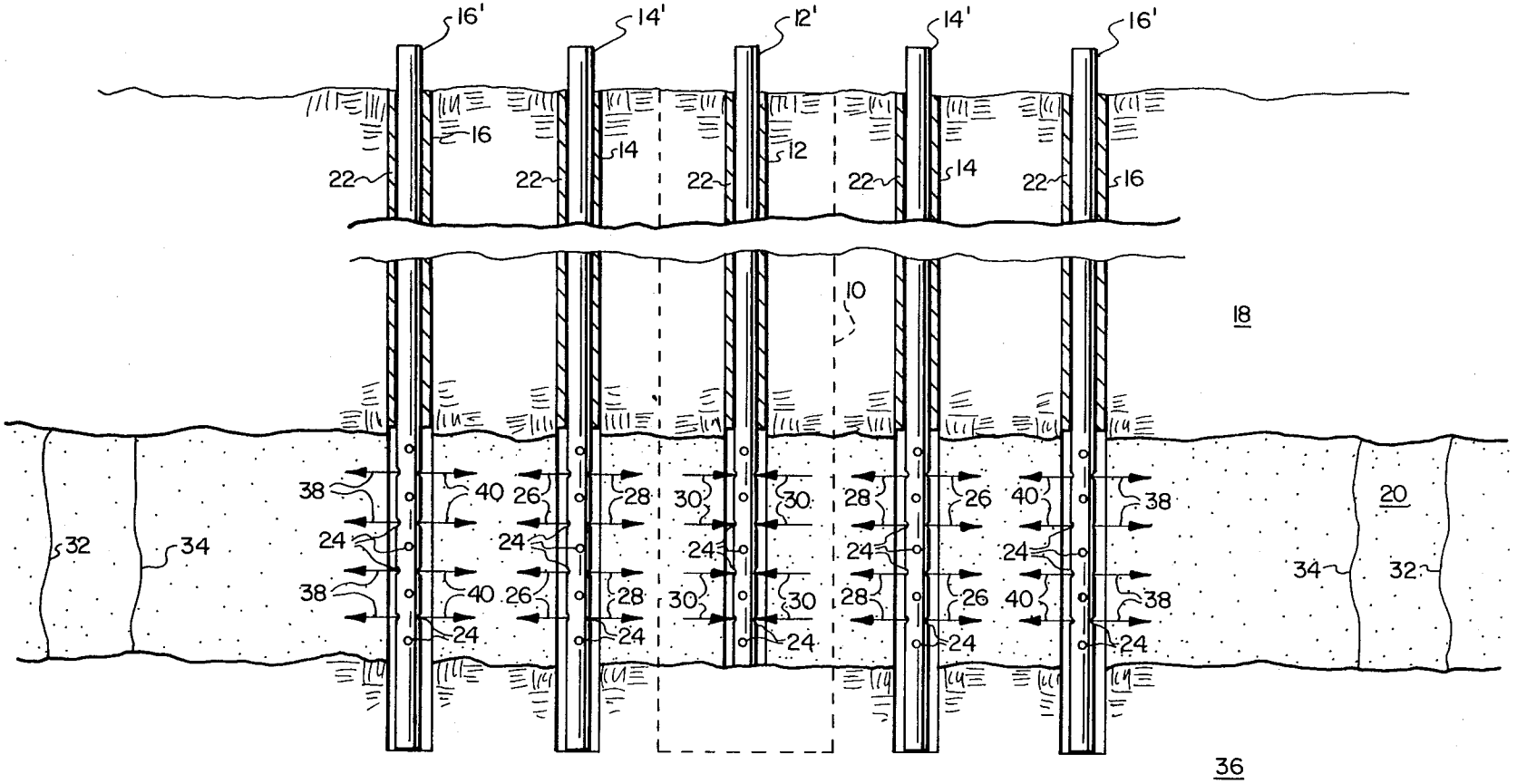

In FIG. 5, a similar well arrangement is shown except that a plurality of outer wells 16 is also used. Such an arrangement may be used when it is desired to form a thicker freeze zone around diameter 10 or when more efficient removal of the oil from zone 20 is desired. In the use of the arrangement shown in FIG. 5, wells 14 are used in the same way as discussed in conjunction with FIG. 3. Outer wells 16 are positioned outside wells 14 and are cased wells having a casing 16' extending through formation 20 and cemented in place by cement 22. Outer wells 16 include a plurality of perforations 24 through casing 16' in zone 20 to permit fluid communication between formation 20 and the annulus of casing 16'. In the use of outer wells 16, desirably a first interval of fluid injection is accomplished through wells 14 to remove oil from the portions of formation 20 between wells 14 and center well 12 and between wells 14 and outer wells 16. After this initial period of fluid injection, during which production is desirably accomplished from central well 12 a further period of fluid injection is initiated through outer wells 16 with continued production through central well 12. A period of concurrent fluid injection through both wells 14 and outer wells 16 could be used if desired with continued fluid production from central well 12. Desirably a final period of fluid injection through outer wells 16 with production of fluids from central well 12 is used to remove as much oil as practical from formation 20. After such injection of fluids through outer wells 16 with the flow of fluids outwardly from outer wells 16 as shown by arrows 38 and inwardly from outer wells 16 as shown by arrows 40 at least a major portion of the oil is removed from formation 20 between outer wells 16 and central well 12 with oil outside outer wells 16 in formation 20 being pushed outwardly away from outer wells 16. Water is then injected to push the injected fluid outwardly beyond outer wells 16 and beyond line 34 with oil in formation 20 being pushed outwardly beyond line 32. Water, injected through either outer wells 16 or wells 14 and outer wells 16, then fills formation 20 out to line 34.

Figure 6:
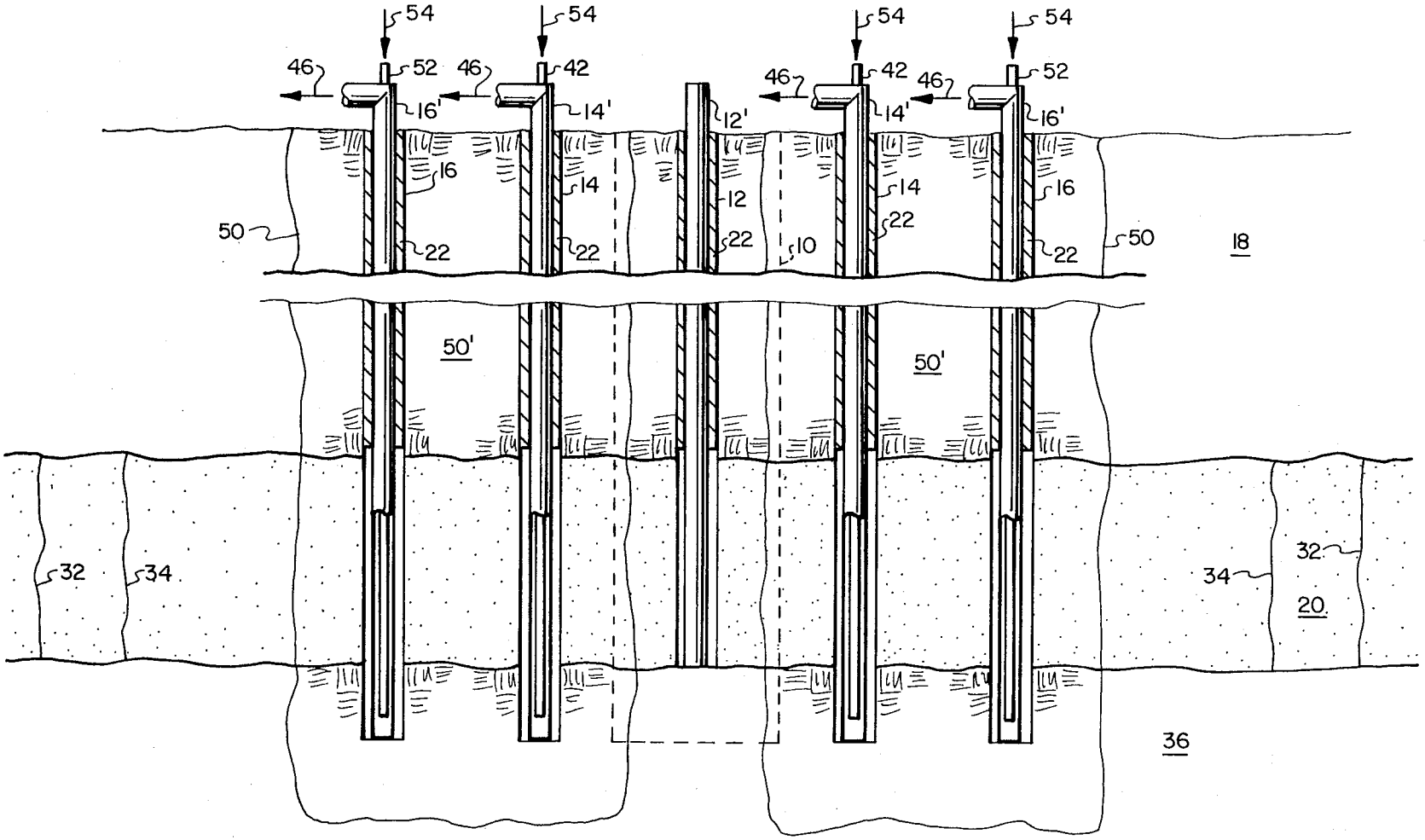
FIG. 6 is a schematic view of the wells in FIG. 5 after the formation of a freeze zone surrounding a large diameter shaft evacuation zone.

After formation 20 has been filled with water, outer wells 16 and wells 14 are converted into heat exchange fluid circulation wells as shown in FIG. 6. A heat exchange fluid is then injected into at least a portion of wells 14 and outer wells 16 as shown by arrows 54 downwardly through tubing 42 in wells 14 and tubing 52 in outer wells 16 to the bottom of the respective tubing and then upwardly through the annulus of casings 14' and 16' for recovery as shown by arrows 46. The recovered heat exchange fluid is then passed to chilling and optional recirculation back into wells 14 and 16. After a continued period of heat exchange fluid circulation, a freeze zone 50' shown by lines 50 is formed. Thereafter, excavation of the large diameter shaft is accomplished in the zone shown by dotted line 10.

Typically, outer wells 16 are arranged in a generally circular pattern from about 5 to about 20 feet outside wells 14. Preferably, outer wells 16 are from about 8 to about 12 feet outside wells 14. The spacing of outer wells 16 to accomplish the desired freezing is well within the skill of those in the art since such techniques have been used previously with aqueous formations. The use of the present method is particularly effective when formations are to be frozen which in their natural state contain materials such as oil which are not readily frozen at temperatures as high as the freezing point of water.

Suitable injection fluids are materials such as steam, heated water, carbon dioxide, aqueous surfactant solutions, and alcohols which are miscible with both water and the formation oil and the like. A wide variety of suitable fluids which are effective to remove oil from subterranean oil bearing formations are known to those skilled in the art and such fluids in general are considered suitable so long as they are readily removed from the formation by water.

The heat exchange fluid may be any suitable fluid which is sufficiently fluid for ready circulation in the respective wells and which has a freezing point sufficiently low that it can be used to cool the subterranean formation to a temperature below the freezing point of water. Some suitable heat transfer fluids are aqueous brines of calcium chloride, sodium chloride, lithium chloride, liquid nitrogen, and the like.

The excavation of the large diameter shaft after the freezing has been accomplished may be accomplished by conventional excavation practices known to those skilled in the art. Freezing has been used in the excavation of large diameter shafts previously, however, the present method has been found to be particularly effective when it is desired to position large diameter shafts through zones such as oil-bearing formations which are not readily frozen by standard techniques. In the excavation of such shafts, the shafts are normally progressively cased to a distance slightly above the bottom of the excavation during excavation and to the substantially full depth after excavation is complete so that once excavation has been accomplished the circulation of heat transfer fluid in wells 14 and outer wells 16 can be stopped.

Central well 12 may be removed in any suitable fashion. For instance, if it is possible, the casing may be removed from central well 12 before beginning excavation of the large diameter shaft or the casing can simply be removed in sections as excavation proceeds.

The selection of the number of wells, the number of rings of wells to be used and the like is dependent upon a multitude of factors known to those skilled in the art, such as the amount of freezing required to adequately consolidate the subterranean formation, the thickness of the freeze zone required to provide adequate strength to maintain the integrity of the surrounding formations during the excavation of the large diameter shaft and the like. Such variations are considered to be known to those skilled in the art and will not be discussed further.

Having discussed the present invention by reference to its preferred embodiments, it is pointed out that the embodiments discussed are illustrative rather than limiting in nature and that many variations and modifications are possible within the scope of the present invention. Such variations and modifications may appear obvious and desirable to those skilled in the art upon a review of the foregoing description of preferred embodiments.

Having thus described the invention, I claim:

1. A method for positioning a large diameter shaft from the surface into the earth and at least partially through a subterranean oil-bearing formation, said method comprising (a) Positioning a central well near the center of a selected shaft location, said central well extending at least partially through said oil-bearing formation;

(b) Positioning a plurality of wells at a selected distance outside the diameter of said shaft and about said shaft, said wells extending at least partially through said oil-bearing formation;

(c) Injecting a fluid through at least a portion of said wells into said oil-bearing formation to remove oil from said oil-bearing formation;

(d) Producing fluids from said central well;

(e) Injecting water into said oil-bearing formation through said portion of said wells after the injection of said fluid through said portion of the said wells;

(f) Freezing a zone about said location; and, (g) Excavating said shaft.

2. The method of claim 1 wherein said fluid is selected from the group consisting of steam, heated water, carbon dioxide, aqueous surfactant solutions and alcohols miscible with both water and the formation oil.

3. The method of claim 1 wherein said wells are arranged in a generally circular pattern from about 5 to about 20 feet outside said shaft diameter.

4. The method of claim 3 wherein said wells are from about 10 to about 15 feet outside said shaft diameter.

5. The method of claim 1 wherein a plurality of outer wells is positioned at a selected distance outside said wells and about said shaft, said outer wells extending at least partially through said oil-bearing formation and wherein a fluid is injected through at least a portion of said outer wells into said oil-bearing formation.

6. The method of claim 5 wherein water is injected into said oil-bearing formation through said portion of said outer wells after the injection of said fluid through said portion of said outer wells.

7. The method of claim 6 wherein a heat transfer fluid is circulated in at least a portion of said outer wells.

8. The method of claim 5 wherein said outer wells are arranged in a generally circular pattern from about 5 to about 20 feet outside said wells.

9. The method of claim 8 wherein said outer wells are from about 8 to about 12 feet outside said wells.

10. The method of claim 1 wherein said zone is frozen by circulating a heat transfer fluid in at least a portion of said wells.

11. The method of claim 10 wherein said heat transfer fluid is selected from the group consisting of aqueous brines of calcium chloride, aqueous brines of lithium chloride, aqueous brines of sodium chloride, and liquid nitrogen.

* * * * *